US012098006B2

(12) United States Patent
Bassi et al.

(10) Patent No.: US 12,098,006 B2
(45) Date of Patent: Sep. 24, 2024

(54) CLOSING CAP FOR A CONTAINER

(71) Applicant: SACMI COOPERATIVA MECCANICI IMOLA SOCIETA' COOPERATIVA, Imola (IT)

(72) Inventors: Vittorio Bassi, Faenza (IT); Alessandro Falzoni, Imola (IT)

(73) Assignee: SACMI COOPERATIVA MECCANICI IMOLA SOCIETA' COOPERATIVA, Imola (IT)

( * ) Notice: Subject to any disclaimer, the term of this patent is extended or adjusted under 35 U.S.C. 154(b) by 210 days.

(21) Appl. No.: 17/642,614

(22) PCT Filed: Sep. 14, 2020

(86) PCT No.: PCT/IB2020/058513
§ 371 (c)(1),
(2) Date: Mar. 11, 2022

(87) PCT Pub. No.: WO2021/053488
PCT Pub. Date: Mar. 25, 2021

(65) Prior Publication Data

US 2022/0340340 A1 Oct. 27, 2022

(30) Foreign Application Priority Data

Sep. 16, 2019 (IT) ..... 102019000016409

(51) Int. Cl.
*B65D 55/16* (2006.01)
*B65D 41/34* (2006.01)

(52) U.S. Cl.
CPC ..... *B65D 55/16* (2013.01); *B65D 41/3428* (2013.01); *B65D 2401/30* (2020.05)

(58) Field of Classification Search
CPC ..... B65D 41/34; B65D 41/3428; B65D 41/3438; B65D 55/16
(Continued)

(56) References Cited

U.S. PATENT DOCUMENTS 2,990,077 A 6/1961 Baarn
2012/0285921 A1* 11/2012 Kwon ..... B65D 55/16 215/243
2020/0115115 A1* 4/2020 Migas ..... B65D 55/16

FOREIGN PATENT DOCUMENTS

FR 2785264 A1 5/2000
WO 2019031779 A1 2/2019

OTHER PUBLICATIONS

Internatonal Search Report and Written Opinion dated Nov. 16, 2020 from counterpart International Patent Application No. PCT/IB2020/058513.

* cited by examiner

*Primary Examiner* — Anthony D Stashick
*Assistant Examiner* — Raven Collins
(74) *Attorney, Agent, or Firm* — SHUTTLEWORTH & INGERSOLL, P.L.C.; Timothy J. Klima

(57) ABSTRACT

A closing cap for a container includes a separating line on a lateral wall forming a retaining ring, configured to remain anchored to a neck of the container and extending up to a free edge. A closing element is engageable with the neck, to open or close the container. The separating line is circumferentially interrupted to define in the lateral wall a joining zone, extending at a first angle, in which the retaining ring and the closing element are joined. An engagement element of the retaining ring is bent when the cap is closed. First and second incision lines allow deformability of a connecting portion and a region of the engagement element extending at a second angle, so that when first opening the closing
(Continued)

element, the region goes beyond the locking ring and deforms to rest on the locking ring in an extended configuration.

18 Claims, 7 Drawing Sheets

(58) Field of Classification Search
USPC ..... 215/243, 252
See application file for complete search history.

CLOSING CAP FOR A CONTAINER

This application is the National Phase of International Application PCT/IB2020/058513 filed Sep. 14, 2020 which designated the U.S.

This application claims priority to Italian Patent Application No. 102019000016409 filed Sep. 16, 2019, which application is incorporated by reference herein.

The invention relates to a closing cap for a container.

In particular, the invention relates to a cap equipped with a retaining ring, which can be associated with a neck of a container, the cap being also equipped with a closing element which, after opening, remains connected to the retaining ring.

The cap according to the invention is particularly, but not exclusively, designed to be applied on bottles intended to contain liquid substances.

Caps for bottles are known comprising a cup-shaped body equipped with an inner thread designed to engage with an outer thread of a neck of the bottle. The prior art caps are also equipped with a security ring connected to the cup-shaped body by means of a tear line equipped with a plurality of breakable elements, for example breakable bridges. When the cap is opened for the first time the cup-shaped body separates from the security ring along the tear line following breakage of the breakable elements. The security ring remains associated with the neck of the bottle, whilst the cup-shaped body can be unscrewed by the user, which in this way separates the cup-shaped body from the bottle to access the contents of the bottle. Subsequently, the cup-shaped body can be re-screwed on the neck to reclose the bottle.

Sometimes, after the bottle has been emptied, the user throws the cup-shaped body on the ground, either intentionally or accidentally, whilst the bottle, together with security ring associated with it, should correctly be disposed of in a waste bin. This behaviour is obviously undesired.

To overcome this drawback, caps have been proposed which are equipped with a retaining ring, which can be associated with a neck of a bottle, and a closing element, connected to the retaining ring by means of a hinge.

The closing element can be rotated about the hinge to position the cap in an open condition, in which a user can access the contents of the bottle, and a closed condition, in which the closing element prevents access to the bottle. The hinge keeps the closing element associated with the retaining ring and, therefore, the bottle, preventing the closing element from being thrown on the ground independently of the bottle.

The known caps equipped with hinge have however the drawback of being rather complicated to manufacture. In effect, the hinge is usually produced in the same mould in which the cap is obtained, particularly by injection moulding or compression moulding.

In order to produce the caps with hinge of known type it is therefore necessary to provide special moulds, different from those which are normally adopted for producing the caps free of the hinge. These moulds are more complicated than the ordinary ones, in particular because the caps with hinge of known type may be equipped with undercut parts, which thus require special means in order to be extracted from the mould.

Moreover, the caps with the hinge of known type may have zones with a very reduced thickness, which are difficult to obtain because the molten polymeric material flows with difficulty in the portions of the mould intended to form these zones.

This increases the costs for the production of the caps with hinge and/or the cycle time necessary obtain them.

The prior art caps equipped with a hinge have, however, a further drawback linked to the fact that the retaining ring, in the open condition, when a user inclines the bottle to pour the contents, can easily rotate and cause the closing element connected to it to also fall downwards by gravity, which in this way can be positioned facing and below the dispensing opening. The user is therefore forced to manually lock the cap before inclining the bottle, in order to avoid undesired splashes or deviations of the content to be poured and have the guarantee that the closing element does not disturb the dispensing.

An aim of the invention is to improve the caps of known type, particularly the caps comprising a retaining ring designed to remain associated with a neck of the container and a closing element removably engageable with the neck to allow a user to open or alternatively close the container.

A further aim is to provide a cap for a container, equipped with a closing element which remains connected to the retaining ring, which in addition can remain stably locked in a position after opening.

According to the invention, there is a cap for a container according to the present disclosure.

In detail, according to the invention, there is provided a closing cap for a container, comprising a lateral wall extending about an axis and a transversal wall positioned at an end of the lateral wall, a separating line being provided on the lateral wall to define: a retaining ring, which is configured to remain anchored to a neck of the container and extends as far as a free edge; a closing element removably engageable with the neck, so as to open or close the container; wherein the separating line extends around the axis and is circumferentially interrupted to define in the lateral wall a joining zone, which extends for a first angle, in which the retaining ring and the closing element are joined; wherein the retaining ring comprises: an engagement element which projects inwards from the free edge and is configured to engage with a locking ring of the neck, the engagement element being in a bent configuration when the cap is in the closed condition; a first incision line and a second incision line, which are transversal to the axis and are positioned circumferentially at the sides of a connecting portion, which is positioned at least in the joining zone and extends for a second angle; the first incision line and the second incision line being configured to allow deformability at least of the connecting portion and of a region of the engagement element, which extends at least in the second angle, so that in a final step of a first opening of the closing element, the region goes beyond the locking ring and can deform, being positioned resting on the locking ring in an extended configuration.

Thanks to the joining zone, the closing element is stably associated with the retaining ring and, therefore, with the neck of the container in the open condition and can be disposed of associated with the container.

Thanks to the first incision line and the second incision line, the connecting portion and the corresponding region of the engagement element positioned between them, can be deformed and therefore the closing element can be locked stably on the neck of the container, when said region rests on the locking element and prevents any rotational movement of the closing element, both towards the dispensing opening and around the neck of the bottle.

In the open condition, the closing element is locked in the movement towards the dispensing opening, since the deformed region of the engagement element, resting on the locking ring, interferes with zones of the neck close to it, and cannot rotate further. Moreover, the retaining ring is also locked in the rotation about the neck, due to the friction between the deformed part and the locking ring which prevents the deformed part from sliding laterally on the locking ring.

The closing element cannot, therefore, fall by gravity.

The region may emit an audible and/or tactile indication when it is extended and has passed beyond the locking ring and therefore the user can perceive when the cap has been completely opened and the closing element is stable in the open condition.

In addition, thanks to the first incision line and the second incision line, the retaining ring can also deform axially, so that said region temporarily passes beyond the locking ring in an initial step of the first opening, allowing the closing element to uncouple from a thread of the neck, and then return below the locking ring, when the closing element has completely uncoupled.

When the user wants to close the container, the region of the engagement element which has been extended can bend again.

Advantageously, to further increase the deformability of the connecting portion, two break lines are made, parallel to the axis, which delimit internally the first incision line and the second incision line.

Consequently, the cap according to the invention may be produced in a relatively simple manner, without need to use special moulds. In effect, the cap according to the invention may be produced in a traditional mould and the incision lines may be made as cutting lines by means of a cutting operation.

The incision lines may pass through the entire thickness of the lateral wall, or not passing through, if the thickness of the lateral wall is to be cut only partly.

However, the incision lines can also be made by moulding, suitably shaping the mould in which the cap is produced, without, however, causing excessive complications of the mould, thanks to the particularly simple shape of the incision lines.

It should also be noted that the joining zone, in which the connecting portion is located, is robust so much that it is difficult to accidentally separate the retaining ring from the closing element.

The invention can be better understood and implemented with reference to the accompanying drawings which illustrate non-limiting example versions of it and in which:

FIG. 1 is a side view of a closing cap according to the invention, associated with a neck of a container, comprising a closing element and a retaining ring connected together by a joining zone, in a closed condition;

FIG. 2 is a side view of the cap of FIG. 1, in an initial step of a first opening of the closing element, wherein the closing element starts to be separated from the retaining ring and a region of an engagement element of the retaining ring, positioned at a connecting portion of the joining zone, temporarily passes beyond a locking ring of the neck to allow the closing element to uncouple from a coupling structure of the neck;

Figure 1:
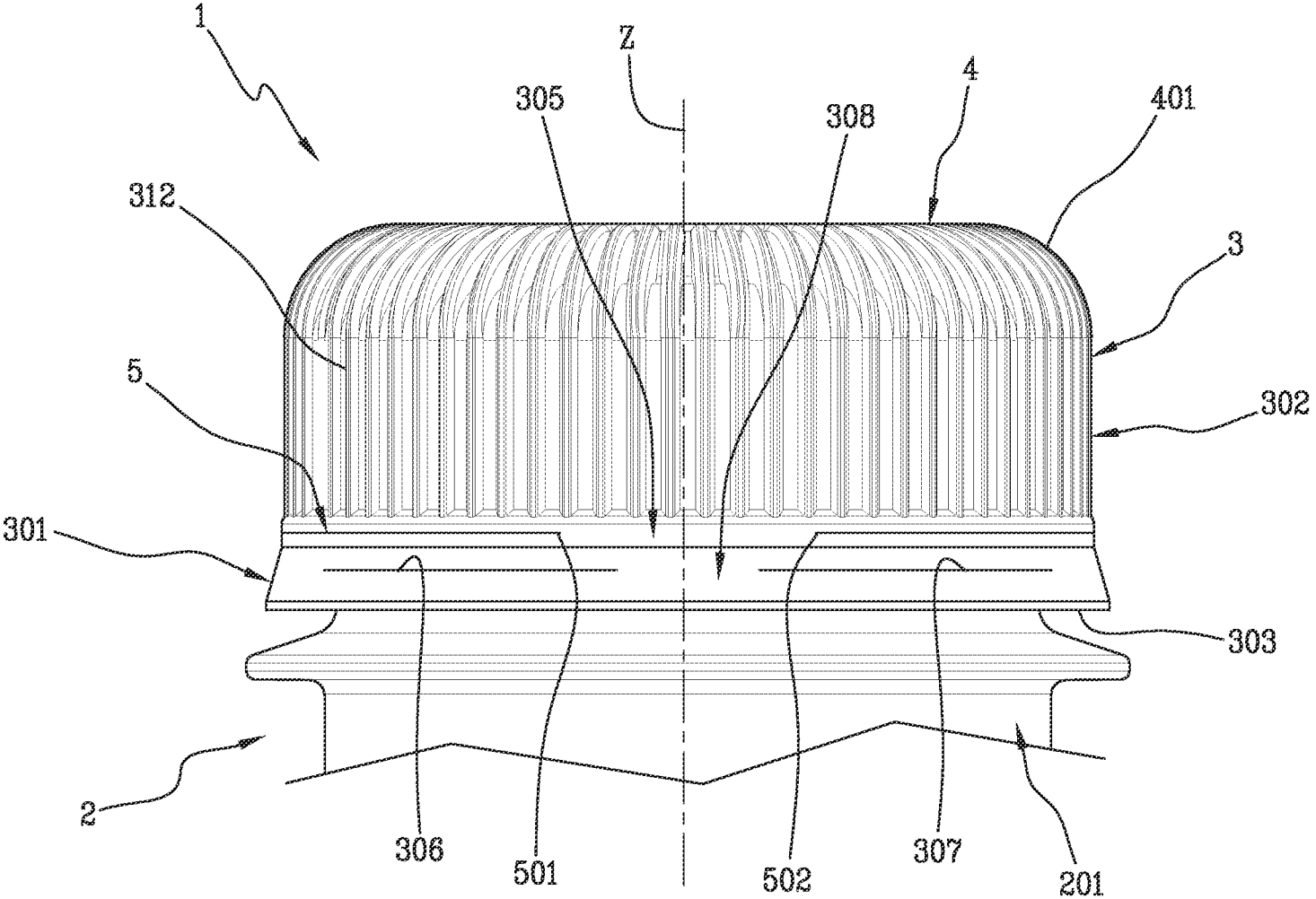

With reference to FIGS. 1 to 8, the numeral 1 denotes a cap for closing a container 2, of which only a neck 201 is shown, particularly a bottle designed to contain a liquid substance such as a drink.

It should be noted that elements common to the different embodiments will be indicated with the same reference numerals.

The cap 1 is made of polymeric material. Any polymeric material suitable for being moulded can be used to obtain the cap 1.

The cap 1 is shown in FIG. 1 in a closed condition in which the cap 1 is located when it leaves a cap production line and is applied on the container 2. In this condition, the cap 1 comprises a lateral wall 3 which extends about an axis Z, and a transversal wall 4 located at an end of the lateral wall 3, so as to close the end. The transversal wall 4 extends transversally, in particular perpendicularly, to the axis Z. The transversal wall 4 may be flat, even though other shapes are theoretically possible. In the example illustrated, the transversal wall 4 has a substantially circular shape in plan view.

The lateral wall 3 and the transversal wall 4 define a cup-shaped body, designed to receive an end portion of the neck 201 of the container 2, so that the cap 1 can close the container 2.

More specifically, the lateral wall 3 is connected to the transversal wall 4 by a connecting zone 401, which may be shaped, in cross section, like a bevelled edge or a circular connector.

Figure 7:
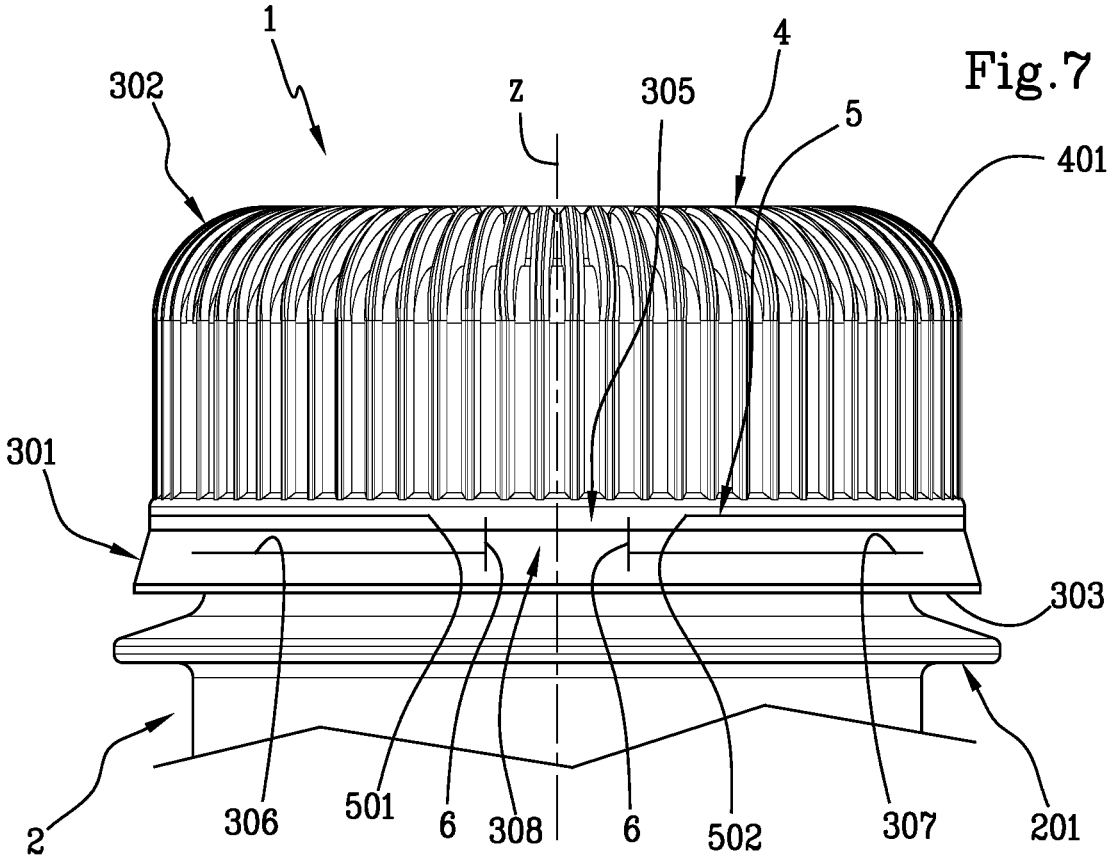
FIG. 7 is a variant of the cap of FIG. 1, which comprises break lines parallel to an axis of the cap.

The cap 1 comprises a separating line 5, shown in FIGS. 1 and 7, which is provided on the lateral wall 3 to form a retaining ring 301, which is configured to remain anchored to the neck 201 of the container 2, and a closing element 302 removably engageable with the neck 201, so as to open or close the container 2, that is to say, open or close a dispensing opening 203 of the neck 201.

The retaining ring 301 extends up to a free edge 303 of the lateral wall 3.

More in detail, the retaining ring 301 is configured to engage internally with a locking ring 202 of the neck 201.

The retaining ring 301 comprises an engagement element, only partly illustrated as described below, which projects from the free edge 303 inwards and is configured to retain anchored the retaining ring 301 to the neck 201 of the container 2, during a passage from a closed condition to an open condition of the cap 1.

When the cap 1 is in the closed condition, the engagement element is positioned in a bent configuration.

The engagement element may be made, in known manner, as a single continuous tab, which projects from the free edge 303, or as a plurality of protruding tabs. The sole continuous tab, or the plurality of protruding tabs, have at the most a length, measured as a distance from the free edge 303, which is suitably selected in such a way that they can engage with the locking ring 202 in the first passage from the closed condition to the open condition of the cap 1.

The engagement element is therefore positioned in a lower portion of the retaining ring 301, and therefore of the cap 1, when the cap 1 is joined to the container 2 and the container 2 is positioned vertically and extends circumferentially for the entire locking ring 202.

Figure 8:
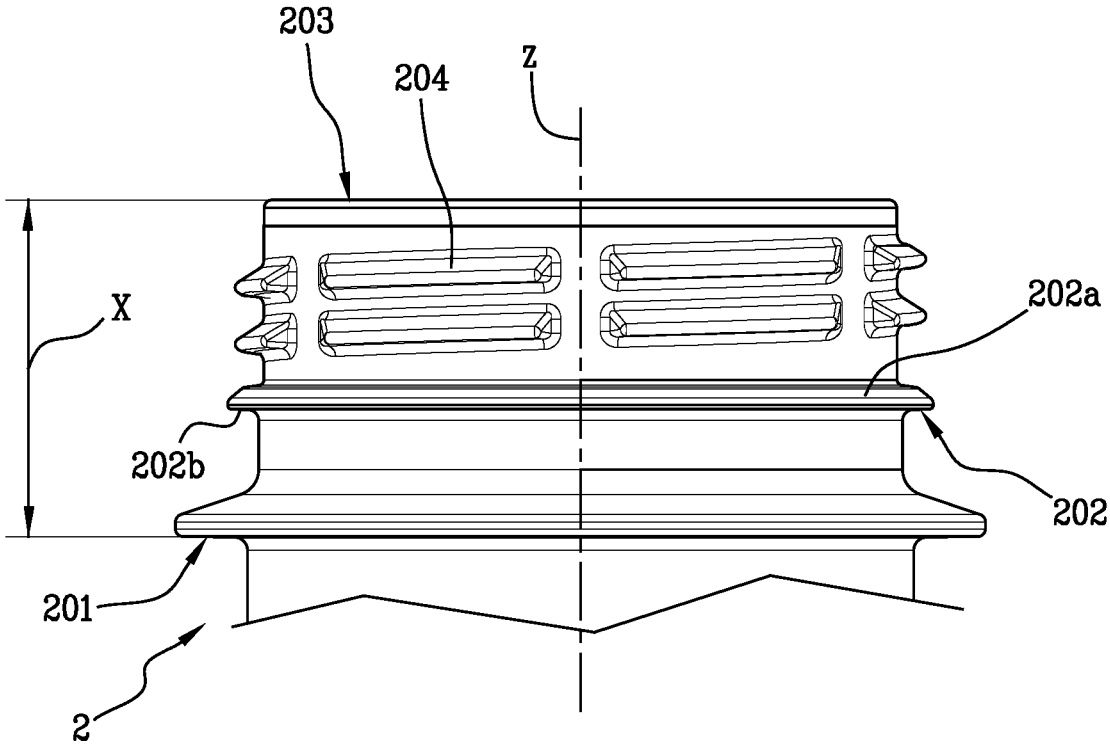
FIG. 8 is a perspective view of the neck of the container of FIGS. 1 to 7.

The locking ring 202 is shown in FIGS. 2 to 6 and in FIG. 8 and projects from an outer surface of the neck 201.

The locking ring 202, shown in detail in FIG. 8, is an annular enlargement, which extends in a plane positioned transversally to the axis Z and has, considering a plane passing through the axis Z, a substantially triangular cross-section. An upper wall 202*a* of the locking ring 202, facing towards the dispensing opening 203, is inclined relative to a base wall 202*b*, facing towards a base (not illustrated) of the container 2. The locking ring 202 has, in other words, the upper wall 202*a* with a frustoconical shape.

The engagement element, when the cap 1 is in the closed condition and has not yet been opened, has a relative end margin facing towards the dispensing opening 203, and is in other words positioned below the locking ring 202 for engaging with the base wall 202*b*.

The free edge 303 delimits the retaining ring 301 on the side opposite the transversal wall 4. The retaining ring 301 therefore extends between the separating line 5 and the free edge 303 and may be delimited by a cylindrical or truncated cone shaped outer surface. Preferably, the separating line 5 is parallel to the free edge 303.

The separating line 5, on the lateral wall 3, defines, in addition to the retaining ring 301, the closing element 302 which can be engaged in a removable fashion with the neck 201, to close a dispensing opening 203 of the container 2.

The separating line 5 extends about the axis Z and is circumferentially interrupted to form in the lateral wall 3 a joining zone 305, which extends angularly for a first angle α, in which the retaining ring 301 and the closing element 302 are joined. More in detail, the separating line 5 extends between a first end 501 and a second end 502.

Between the first end 501 and the second end 502, the joining zone 305 acts as a hinge, about which the closing element 302 can rotate relative to the retaining ring 301.

The retaining ring 301 comprises a first incision line 306 and a second incision line 307, which are transversal to the axis Z. The retaining ring 301 also comprises a connecting portion 308, at the sides of which are circumferentially positioned the first incision line 306 and the second incision line 307.

The connecting portion 308 is positioned in the joining zone 305 and extends for a second angle β. Preferably, but not exclusively, the second angle β is less than the first angle α.

The connecting portion 308 is a part of the joining zone 305.

The first incision line 306 and the second incision line 307 extend, respectively, for a third angle γ and for a fourth angle ε.

The first incision line 306 and the second incision line 307 are configured to allow a deformability at least of the connecting portion 308 so that in a final step of a first opening of the closing element 302, a region 309 of the engagement element, which extends at least in the second angle β, passes beyond the locking ring 202 and can deform, resting on the locking ring 202 in an extended configuration.

Figure 4:
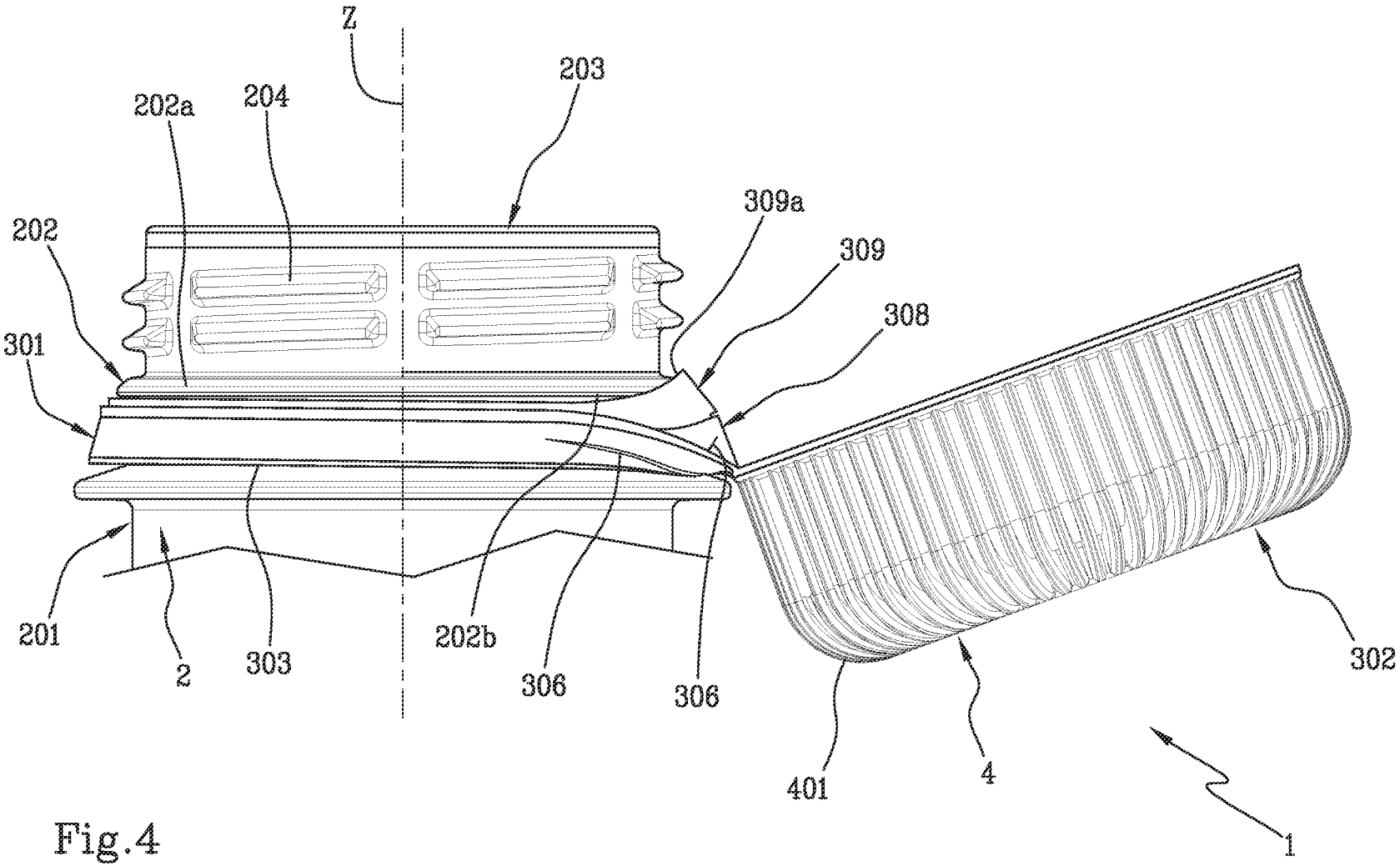
FIG. 4 is a side view of the cap of FIG. 1 in an open condition, wherein the closing element is spaced from the neck of the container and the region of the engagement element has extended, has passed beyond the locking ring resting on it and has deformed.
Figure 5:
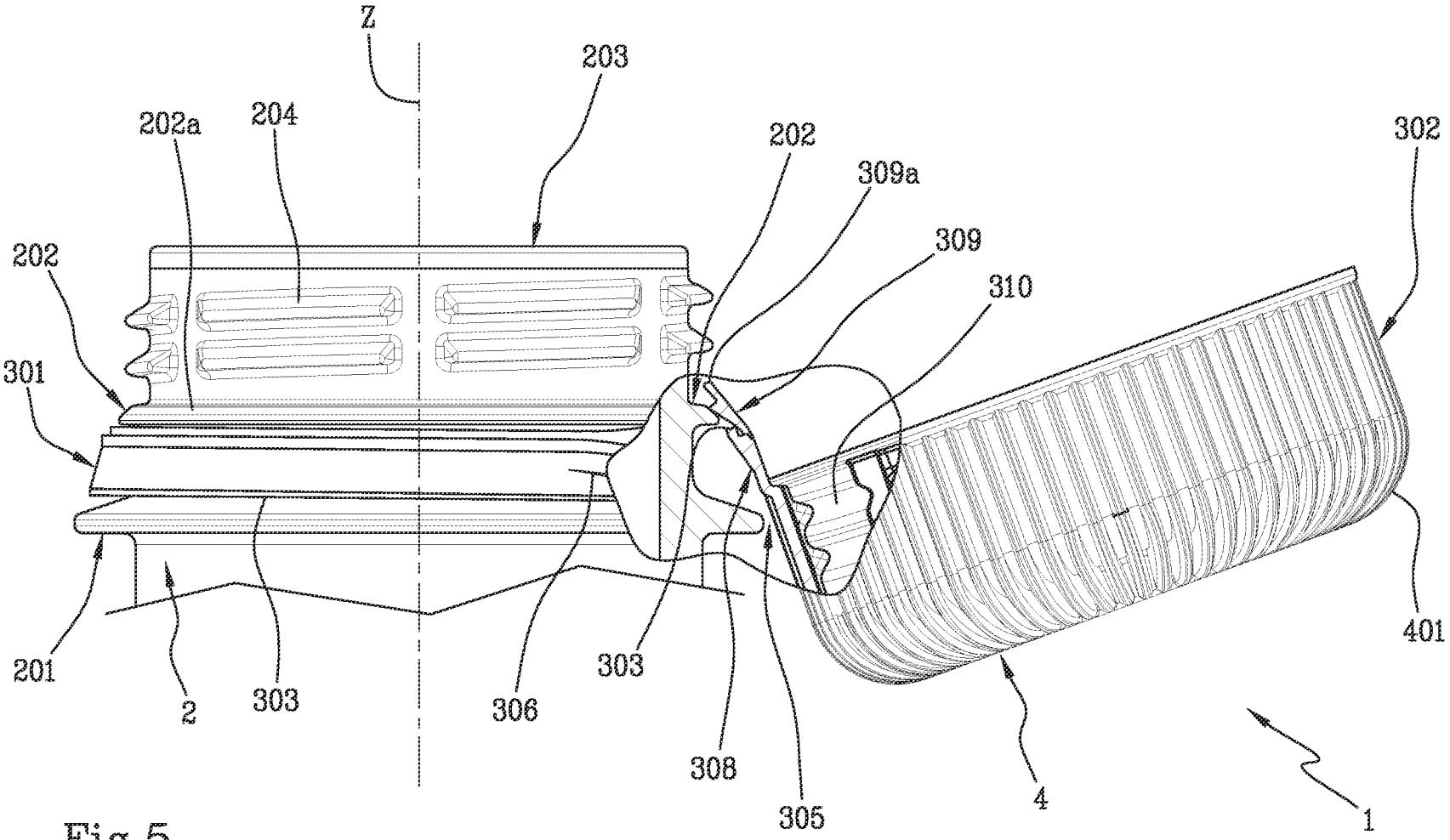
FIG. 5 shows the cap of FIG. 4 in the open condition, with some parts cut away for clarity to show a cross-section of the cap at the connecting region and at the connecting portion.

The region 309, shown in FIGS. 4 and 5, is identified as the part of the engagement element which extends at least in the second angle β and corresponds angularly to the connecting portion 308, but it should be noted that it does not differ from the remaining parts of the engagement element. If, therefore, the engagement element is made as a continuous tab or as a plurality of tabs, the region 309 is also made, respectively, as a continuous tab, or as a plurality of tabs, provided that at least one tab of the plurality of tabs is present in the region 309.

The region 309 has a relative end margin 309*a*.

The term "first opening" of the closing element 302 means the first time the cap 1 is opened and the closing element 302 is separated from the retaining element 301.

Thanks to the joining zone 305, the closing element 302 is stably associated with the retaining ring 301 and, therefore, with the neck 201 of the container 2, when the cap 1 is in the open condition. This prevents the closing element 302 from being thrown on the ground separately from the container 2. This thus increases the probability that the closing element 302, together with the container 2, is correctly disposed of together with waste of the same type, in particular together with plastic material waste.

Thanks to the first incision line 306 and the second incision line 307, the retaining ring 301 can deform at least at the connecting portion 308 and the region 309, interposed between the first incision line 306 and the second incision line 307, when the cap 1 is opened the first time and passes from the closed condition to the open condition.

In effect, the first incision line 306 and the second incision line 307, give the connecting portion 308 deformability and, consequently, also the region 309 of the engagement element. This deformability allows the region 309 to extend and the connecting portion 308 to be pulled in twisting mode, following the region 309 when the region 309 rests on the locking ring 202.

As may be noted in FIGS. 4 and 5, when the region 309 of the engagement element is in the extended configuration, that is to say, the cap 1 is in the open configuration, the connecting portion 308 is overturned, that is to say, it is deformed, rotating and overturning. The free edge 303 of the connecting portion 308 is facing towards the dispensing opening 203 of the container 2 and no longer towards a bottom of the container 2, as in the remaining part of the retaining ring 301.

Figure 2:
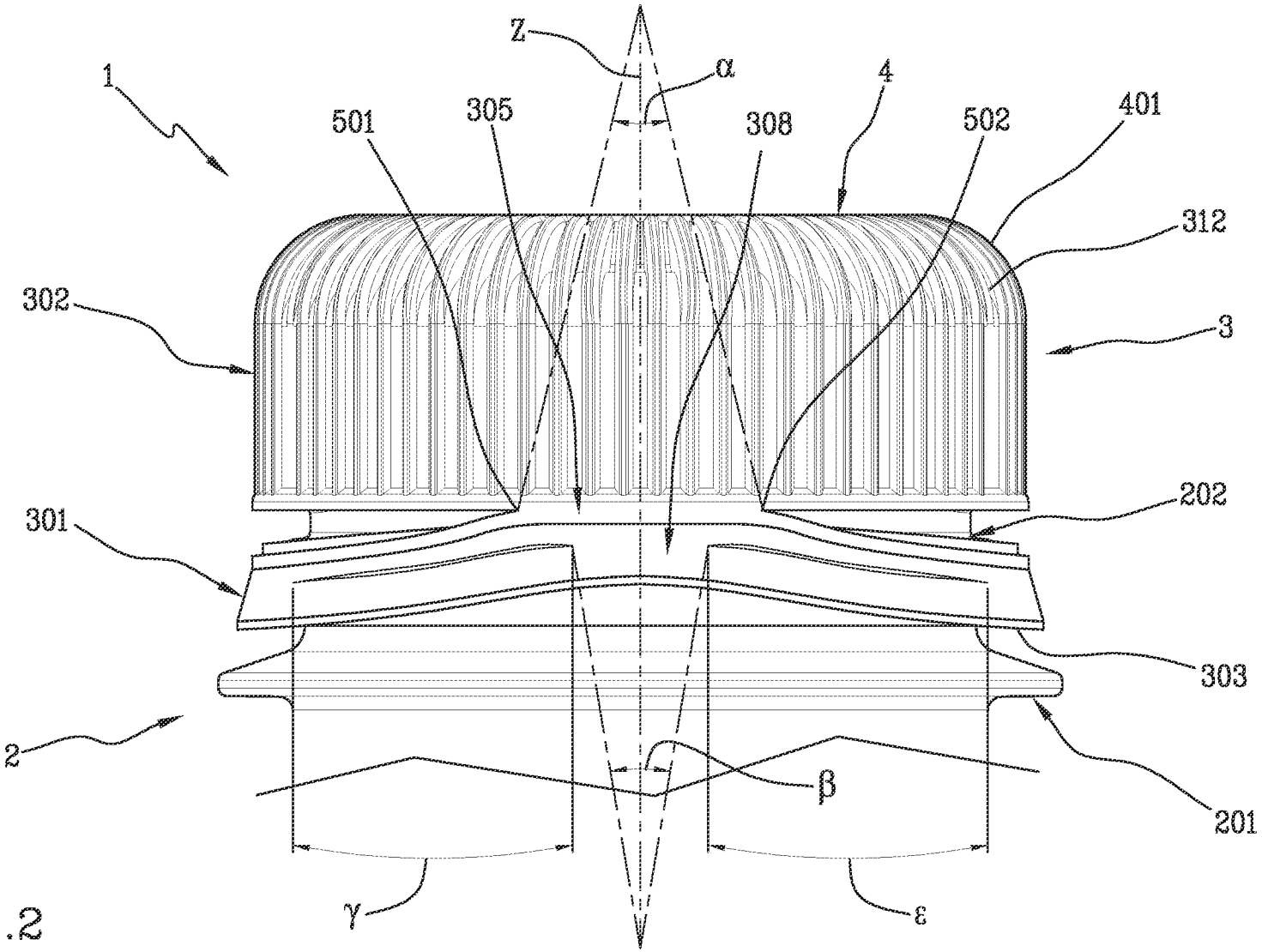
Figure 3:
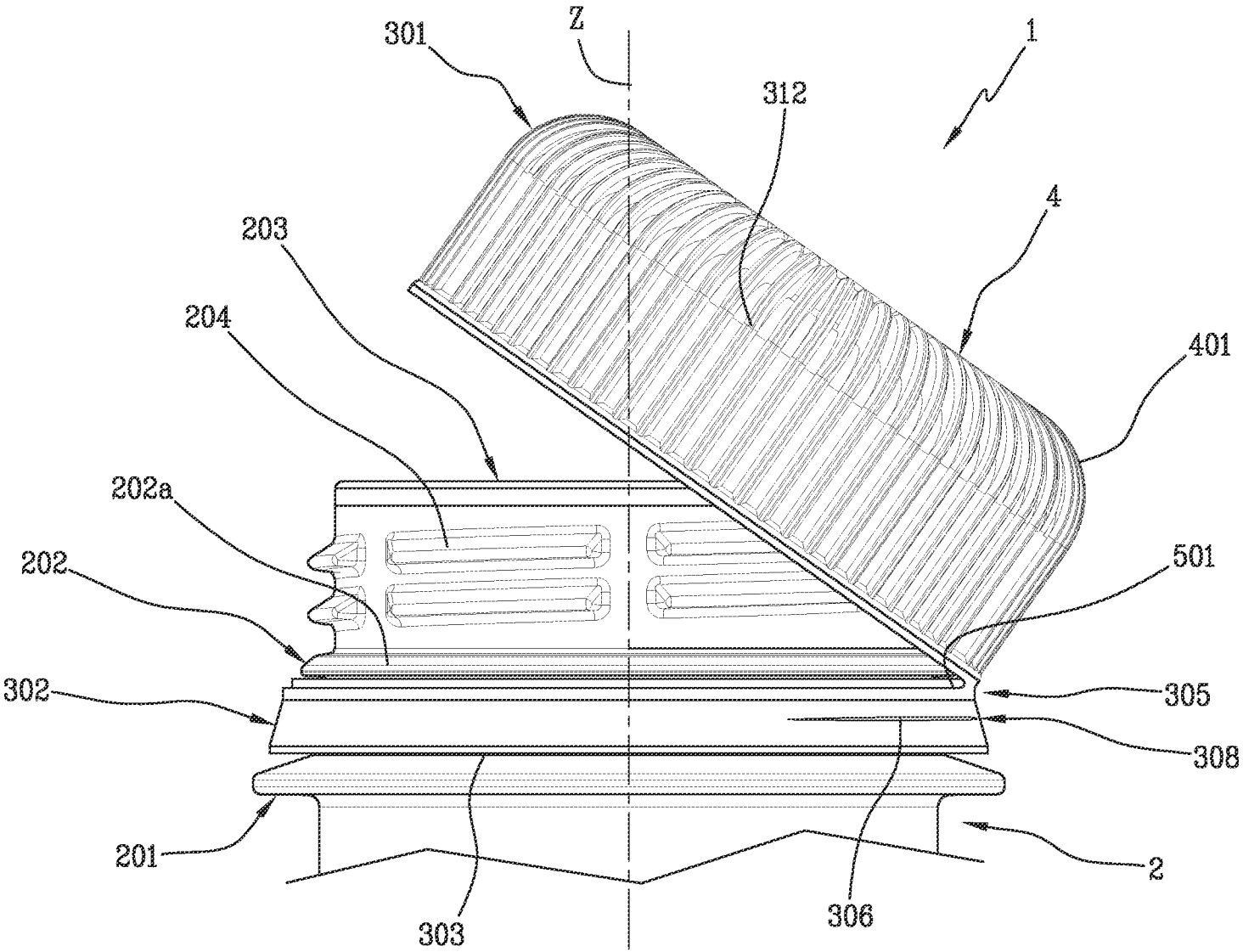
FIG. 3 is a side view of the cap of FIG. 1, wherein the closing element has completely uncoupled from the neck and the region is again positioned beneath the locking ring.

The first incision line 306 and the second incision line 307 respectively define in the retaining ring 301 a first connecting band and a second connecting band, each divided into two strips separated from each other by edges defined by the respective incision line 306, 307. Thanks to the fact that each connecting band has two strips, which can move axially away from each other, as shown in FIG. 2, or can flex differently from each other, as shown in FIGS. 4 and 5, the connecting portion 308 and the region 309 are made deformable. The region 309 may extend down whilst the connecting portion 308 can overturn.

Since, in the open condition, the region 309 of the engagement element rests on the locking element 202 in the extended configuration and the first connecting band and the second connecting band are subjected to flexing, at the end of the first opening of the cap 1 any rotational movement of the closing element 302 is prevented, both towards the dispensing opening 203 and around the neck 201 of the container 2.

In fact, even if a user accidentally strikes the closing element 302, stressing it towards the container 2, the closing element 302 is locked spaced from the neck 201 and cannot move towards it since the region 309 is resting on the locking ring 202. Moreover, the closing element 302 is locked in rotation about the neck both because the region 309 is resting on the locking ring but also because the connecting bands, defined by the first incision line 306 and by the second incision line 307, are subjected to flexing.

As described below, the closing element 302 can return to close the container 2 only if stressed in a specific direction.

The region 309 is configured for emitting, advantageously, an audible and/or tactile indication, in the final step of the first opening, when the entire region 309 passes beyond the locking ring 202 and can extend.

The region 309 may emit a "click" and vibrate as an audible and/or tactile indication of its passage from the bent configuration to the extended configuration.

Thanks to the audible and tactile indication, the user can perceive when the closing element 302 is stable in the open condition.

The first incision 306 and the second incision 307 allow the connecting portion 308 to be also deformable along an axis parallel to the axis of symmetry Z, as shown in FIG. 2, so that, in an initial step of the first opening, the region 309, still in the bent configuration, can temporarily pass beyond the locking ring 202 moving towards the end edge 201*a* of the neck 201, to allow the closing element 302 to disengage completely from the neck 201. Subsequently, after the closing element 302 has disengaged, the region 309 may again pass beyond the locking ring 202, moving in the opposite direction, that is, towards a bottom of the container 2.

The lateral wall 3 of the cap 1 is equipped internally with a coupling structure 310, configured for removably couple the closing element 302 to the neck 201 of the container 2, in such a way that the cap 1 can be moved from the closed condition, wherein the cap 1 closes the dispensing opening 203 of the container 2, to the open condition.

The coupling structure 310 of the cap 1 is positioned inside the closing element 302 and is shaped to engage with a corresponding coupling structure 204 present externally on the neck 201 of the container 2. The coupling structure 310 of the closing element 302 and the coupling structure 204 of the neck 201 are, as illustrated in the accompanying drawings, made as a thread. In this case, the passage from the closed condition to the open condition is performed by a rotation of the closing element 302 relative to the neck 201 of the container 2.

The closing element 302 is disengaged completely from the neck 201 when the coupling structure 310 of the cap 1, that is to say, the thread 310 of the cap 1, has unscrewed from the coupling structure 204 of the neck 201, that is to say, from the thread 204 of the neck 201.

The region 309, after temporarily passing beyond the locking ring 202 to allow the connecting portion 308 to deform along the axis parallel to the axis Z, it is configured for bending again and returning beneath the locking ring 202, in the arrangement which it had in the closed condition.

In this way, the region 309 can emit the audible and/or tactile indication in the final step of the first opening, when the entire region 309 passes beyond the locking ring 202, as described above.

Figure 6:
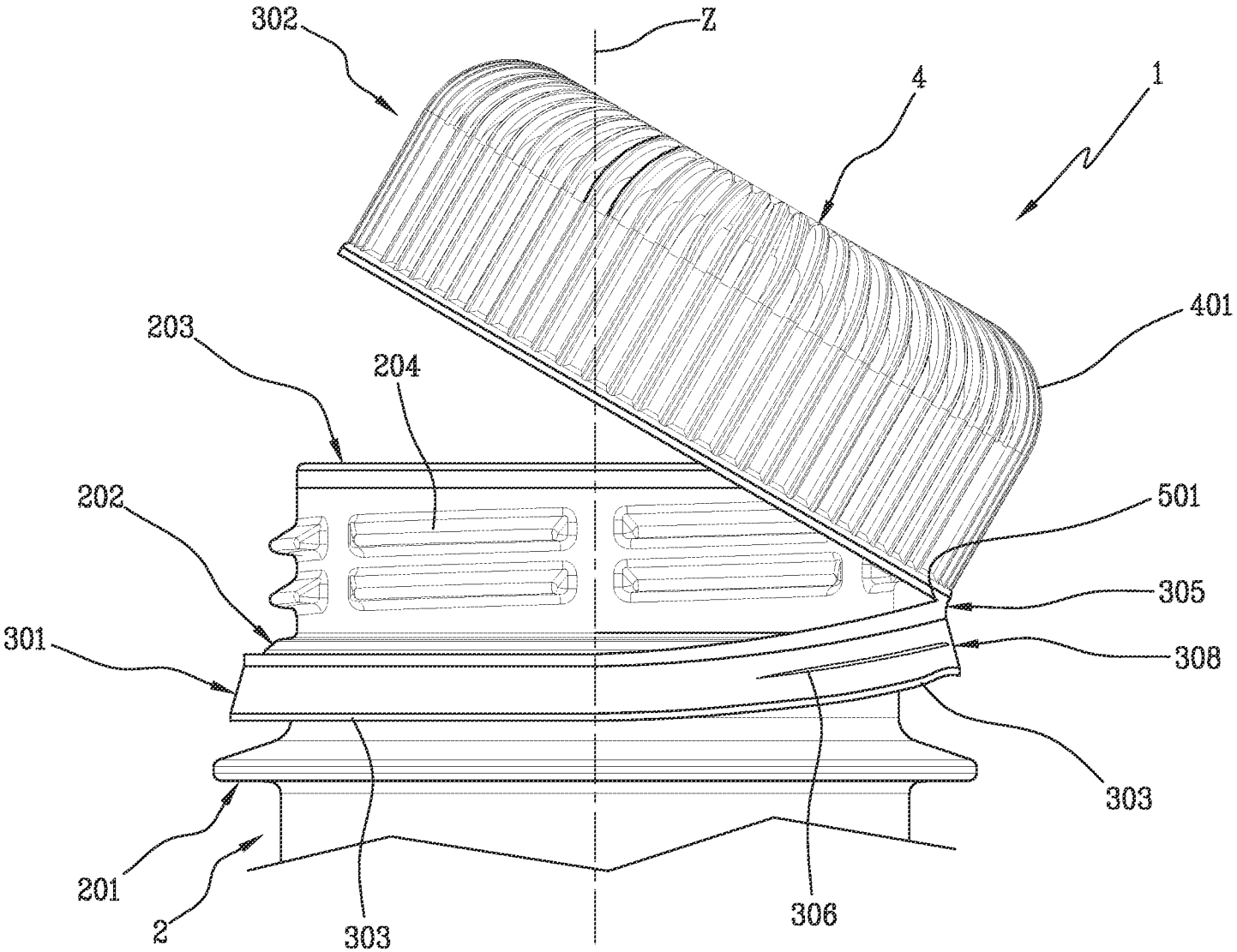
FIG. 6 is a side view of the cap of FIG. 1, in a step of closing after the first opening, wherein the region is bent again resting on the locking ring of the neck.

As shown in FIG. 6, when the closing element 302 is again positioned to close the neck 201 of the container 2, the engagement element is again positioned in the bent configuration but remains resting on the locking ring 202. The engagement element, after the first opening, may not have the same bent configuration which it had before the first opening, having been subjected to a deformation, but it is in any case bent.

The first incision line 306 and the second incision line 307 are interposed between the separating line 5 and the free edge 303 of the retaining ring 301.

As shown in the accompanying drawings, the first incision line 306 and the second incision line 307 are parallel to the separating line 5.

More in detail, the first incision line 306 and the second incision line 307 lie in a same plane perpendicular to the axis Z and have equal length.

However, the first incision line 306 and the second incision line 307 may also be inclined relative to an axis parallel to the axis Z, having different inclinations relative to each other, having a different shape, for example arched, and/or different inclination and/or different length.

For example, according to a variant embodiment not illustrated, the first incision line 306 and the second incision line 307 may be positioned offset on different planes, even if they are parallel to each other and parallel to the separating line 5, and may also be of different lengths and that is to say they may extend for a different angular extension. In this case, the first connecting band and the second connecting band, which may be subjected to flexing, may be of different lengths.

The joining zone 305 has a centre line, a centre line of the connecting portion 308 coinciding with the centre line of the joining zone 305. The first incision line 306 and the second incision line 307 are positioned symmetrically relative to a plane containing the axis Z and the centre line of the joining zone 305.

Advantageously, the symmetry of the arrangement of the first incision line 306 and of the second incision line 307 acts in conjunction in reducing the involuntary movements of the closing element 302 when the closing element 302 is locked resting on the neck 301 and limits the lateral movements.

In fact, if the incision lines are symmetrical relative to the midline of the joining zone 305, advantageously the deformability of the connecting portion 308 is symmetrical and this limits the lateral movements of the closing element 302. In this way, the closing element 302 cannot rotate around the neck 201.

FIG. 7 shows a variant of the cap of FIG. 1, wherein there are two break lines 6 which are configured to give further deformability to the connecting portion 308 and to the region 309 and they are positioned in the connecting portion 308.

It should be noted that the break lines 6 delimit internally, respectively, the first incision line 306 and the second incision line 307 and, that is, they are positioned at the inner ends of the first incision line 306 and of the second incision line 307 which circumferentially delimit the connecting portion 308.

However, alternatively, the break lines 6 may be inside the connecting portion 308 and that is to say, there could be a non-cut portion between an incision line 306, or 307, and the respective break line 6.

The break lines 6 may extend parallel to each other, parallel to the axis Z and have the same length, as in FIG. 7, but they may also be curved and of different length depending on the effect to be obtained.

The break lines 6 may be made by means of incisions passing through an entire thickness of the lateral wall, or, alternatively, they may also be shaped as lines of weakness, at which the thickness of the lateral wall 302 is very reduced relative to the surrounding zones to facilitate the break. Optionally, along each break line 6 there may be one or more breakable bridges designed to be broken the first time the cap 1 is brought to the open condition.

The break lines 6, as shown in FIG. 7, may be perpendicular to the first incision line 306 and to the second incision line 307.

The first angle α defining the joining zone 305 is between 20° and 90° preferably between 40° and 60°.

The second angle β which defines the connecting portion 309 is between 5° and 90°, preferably between 10° and 60°, even more preferably equal to 20°.

The first incision line 306 and the second incision line 307 extend, respectively, for a third angle γ, and for a fourth angle ε which are each between 20° and 90°, preferably between 30° and 60°.

With these angular amplitudes, the connecting portion 308 is sufficiently reduced to be able to be deformed and also the first connecting band and the second connecting band are sufficiently extended to be able to flex when the cap 1 is in the open condition. At the same time, the connecting portion 308 is very robust, since it is also part of the joining zone 305, and is sufficiently extended to anchor the closing element 302 to the locking ring 202 of the neck 201 of the container 2.

When the closing element 302 is in the open condition, between the closing element 302, positioned spaced from the neck 201, and an axis parallel to the axis Z and tangential to the lateral surface of the neck 201, an angle of opening is defined at least equal to 30°, not illustrated, which guarantees that the closing element 302 does not interfere with the dispensing of the contents of the bottle when the bottle is inclined.

It should be noted that the angles α, β, γ and ε shown in FIG. 2 extend about the axis Z and have been shown as if the view of the cap 1 were from above and that is to say, from the side of the transversal wall 4.

It should be noted that the lateral wall 302 can be equipped, on a relative outer surface, with a plurality of knurling lines 312, extending parallel to the axis Z and designed to facilitate gripping of the cap 1 by the user or by the capping machine which applies the cap 1 on the container 2 to be closed.

The knurling lines 312 may be positioned in the closing element 302 but may also optionally continue in the retaining ring 301.

In the example shown, it should be noted that the lateral wall 3 comprises a cylindrical portion on which the knurling lines 312 are made which extend up to the connecting zone 401, a wide portion extending up to the free edge 303 of the retaining ring 301 and a connecting portion positioned between the cylindrical portion and the wide portion. The wide portion has a diameter greater than the cylindrical portion. The wide portion may be delimited by a smooth outer surface, that is to say, it may be without knurling lines, but this is not necessary since the knurling lines could also extend on the wide portion. The closing element 302 is defined by the cylindrical portion, the retaining ring 301 is formed by the wide portion since the separating line 5 is provided on the connecting portion. However, other configurations of the cap 1 might be possible, in relation to the position of the separating line 5 and the extension of the knurling lines 312.

The first incision line 306 and the second incision line 307 may be shaped as through cuts which pass through the entire thickness of the lateral wall 302, and, that is to say, of the retaining ring 301. Alternatively, the first incision line 306 and the second incision line 307 may be shaped as lines of weakness not passing through the entire thickness of the lateral wall 302, but at which the thickness of the lateral wall 302 is very reduced relative to the surrounding zones to facilitate the breaking of the incision lines 306 and 307 in the retaining ring 301.

Along the separating line 5 there may be a plurality of breakable bridges, not illustrated, which connect the retaining ring 301 to the closing element 302. The breakable bridges are designed to be broken the first time the cap 1 is moved to the open position, to signal that the container is no longer whole.

The breakable bridges could also be present along the first incision line 306 and/or the second incision line 307.

The closing element 302 separates from the retaining ring 301 along the separating line 5.

The cap 1 described here may be, for example, applied to containers 2 having a neck 201, shown in FIG. 8, which extends for a height X along the axis Z which is greater than or equal to 9 mm and is less than or equal to 27 mm, that is to say, 9 mm≤X≤27 mm.

Considering the CETIE standards, which publishes reference technical documentation and standards relative to the bottling sector, the cap 1 according to the invention may be advantageously, but not exclusively, applied to necks 201 included in the following list:

GME 30.39; GME 30.28; GME 30.37; GME 30.38; GME 30.32; GME 30.23; GME 30.24; PC01881; PC01873; PC01810; GME 30.26; GME 30.33; GME 30.21; GME 30.22; GME 30.36; GME 30.31; GME 30.30; GME 30.25; GME 30.29.

The code "GME" means the coding standard for the specifications on necks (Finishes data-sheets) of CETIE.

The code "PCO" is the English acronym for Plastic Closure Only and that term, followed by a four digit number, such as for example 1881, is frequently used by the ISBT association (International Society of Beverage Technologists).

The above-mentioned codes identify all the dimensional characteristics of the necks 201.

In use, at the end of a moulding procedure, a cap 1 is obtained, as shown in FIG. 1, which is applied on the neck 201 of the container 2 in the closed condition shown in FIG. 1 and is positioned in such a way that the engagement element provided inside the retaining ring 301, is below the locking ring 202 present on the neck 201, for engaging with the base wall **202*b* of the locking ring 202**.

When the user wishes to open the container for the first time, the user grips the closing element 302 and rotates the closing element 302 about the axis Z, in order to unscrew the closing element 302 from the neck 201.

Initially, during the passage from the closed condition to the open condition, the closing element 302 and the retaining ring 301 are rotated together about the axis Z, and they simultaneously move together in a direction parallel to the axis Z, away from the neck 201.

This occurs until the engagement element of the retaining ring 301 abuts against the locking ring 202 provided on the neck 201. At this point, the locking ring 202 prevents the retaining portion 301 from rising further along the axis Z, acting as a stop for the movement of the retaining ring 301, away from the neck 201.

The closing element 302, which is unscrewed by the user, continues to be stressed along the axis Z away from the neck 201 and also pulls the joining zone 305 and the connecting portion 308 connected to it.

The region 309 of the engagement element, located at least in the second angle 13 is also stressed away from the neck and, thanks to the first incision line 306 and the second incision line 307 which define respective connecting bands of the retaining ring 301, which can be deformed, the region 309 can temporarily pass beyond the locking ring 202, allowing the connecting portion 308 and the joining zone 305 to have a facilitated movement in an axis parallel to the axis Z to continue to follow the joining zone 305 and the closing element 302 away from the neck of the container 2.

The breakable bridges present along the separating line 5 are tensioned until they break. The closing element 302 separates from the retaining ring 301 along the separating line 5, but remains joined to the retaining ring 301 at the joining zone 305. The first connecting band and the second connecting band are inclined following the closing element 302 and connect the closing element 302 to the part of the retaining ring 301 still locked by the locking ring 202.

In effect, in the part of the retaining ring 301, at least outside the region 309 and/or the third angle γ in which the first incision line 306 extends and/or the fourth angle ε in which the second incision line 307 extends, the engagement element is still below the locking ring 202.

The region 309, still in the bent configuration, remains positioned beyond the locking ring 202 until the user, continuing to unscrew the closing element 302, completely disengages the closing element 302 from the thread 204 made on the neck 201 and the container 2 is opened.

When the user further rotates the closing element 302 to free the dispensing opening 203, the closing element 302, which is hinged to the retaining ring 301 by means of the joining zone 305, stresses the connecting portion 308 towards the locking ring 202 and consequently also stresses the region 309 towards the bottom of the container 2.

This moves again the region 309 of the engagement element beneath the locking ring 202.

To completely free the dispensing opening 203 and position the closing element in the open condition, the user continues to rotate further the closing element 302 away from the neck 201. During this final opening step, the entire region 309 passes beyond the locking ring 202 and is deformed resting on the locking ring 202.

The region 309 emits the "click" and vibrates as an audible and/or tactile indication.

The free edge 303 of the retaining ring 301 is pulled by the extension of the region 309 and also rotates, deforming and facing towards the dispensing opening 203 substantially aligned with the region 309. The connecting portion 308 is also rotated by the free edge 303 and is positioned substantially aligned with the region 309, as shown in FIGS. 4 and 5, overturning. It should be noted, however, that between the region 309 and the connecting portion 308 they might be positioned not aligned but define between them an external angle greater than 180°, even though the connecting portion 308 is overturned.

The connecting bands, that is to say, the portions of the retaining ring 301 on which are made the first incision line 306 and the second incision line 307 are subjected to flexing and deform, connecting the deformed connecting portion 308, with the remaining part of the retaining ring 301, still positioned below the locking ring 202.

When the cap is in the open condition, the closing element 302 is spaced relative to the neck 201, as shown in FIGS. 4 and 5, and is stably locked in position by the fact that the region 309 of the engagement element rests extended on the neck 201, the connecting portion 308 is deformed and overturned. The connecting bands are subjected to flexing and deformed for connecting the connecting portion 308, substantially aligned with the region 309 and overturned, with the remaining part of the retaining ring 301, still positioned beneath the locking ring 202.

As stated above, the deformed arrangement of the retaining ring 301 at least at the second angle β, in which extends the connecting portion 308 and the region 309, and the angles γ and ε in which extend the first incision 306 and the second incision 307, prevents the closing element 302 from making any involuntary rotational movement, both towards the dispensing opening 203 and around the neck 201 of the container 2, due to an involuntary impact by the user.

After use, the user can return the cap 1 from the open condition of FIGS. 4 and 5 to the closed condition shown in FIG. 1 by a sequence of operations opposite to that described above.

In order to disengage the region 309 from the locking ring 202, the user must firstly move the closing element 302 away from the neck 201, further deforming the connecting portion 308.

The user must deform the connecting portion 308 in the same direction as the region 309 positioned resting on the locking ring 202 and that is to say in a direction parallel to the upper wall 202*a* of the locking ring 202, so that the region 309 can slide on the upper wall 202*a* when the closing element 302 is pulled away from the container 2.

Subsequently, the user can reapply the closing element 302 on the neck 201, rotating the closing element 302 around the joining zone 305 and axially moving the closing element 302 away from the neck 201, before screwing again the closing element 302 on the thread 204 of the neck 201.

When the closing element 302 moves towards the dispensing opening 203, the region 309 remains resting on the locking ring 202 after the first opening and bends again, the connecting portion 308 returns to the initial configuration of the lateral wall 3, wherein it is parallel to the axis Z.

When the closing element 302 is again positioned in the closed condition, to close the dispensing opening 203, the region 309, whilst being bent as shown in FIG. 6, is still positioned resting on the locking ring 202.

Continuing to close the container 2, that is to say, engaging again completely the thread 204 of the neck 201, the region 309 is positioned again beneath the locking ring 202, passing beyond the locking ring 202.

If the user leaves the region 309 resting on the locking ring 202, when the cap 1 is in the closed condition, at each opening after the first opening the region 309 will again be positioned in the extended configuration and the connecting portion 308 will be overturned substantially aligned with the region 309 but the region 309 will not emit the audible and/or tactile indication since the end edge 309*a* will always be positioned above the locking ring 202.

On the other hand, if the user positions the region 309 beneath the locking ring 202 in the closed condition, the audible and/or tactile indication can be again emitted, at least in the first openings, during the final step of each opening, as illustrated above.

To make a cap 1 for a container 2 according to the invention, a method is provided which comprises the following steps:

- providing a lateral wall 3 of the cap 1 extending around an axis Z and a transversal wall 4 positioned at one end of the lateral wall 3;
- cutting a separating line 5 on the lateral wall 302 which extends around the axis Z to define:
- a retaining ring 301, configured for anchoring the retaining ring 301 to the neck 201;
- a closing element 302 removably engageable with the neck 201, so as to open or close the container 2;

wherein the step of cutting the separating line 5 comprises interrupting the cut, to leave joined the retaining ring 301 and the closing element 302 in a joining zone 305, which extends angularly for a first angle α; wherein the method comprises the step of cutting a first incision line 306 and a second incision line 307 transversally relative to the axis Z at the sides of a connecting portion 308, which is positioned at least in the joining zone 305 and extends angularly for a second angle β to allow a deformability at least of the connecting portion 308 and of a region 309 of the engagement element, which extends at least in the second angle β, so that in a final step of a first opening of the closing element 302, the region 309 passes beyond the locking ring 202 and can deform, resting on the locking ring 202 in an extended configuration.

The method comprises the step of making a first incision line 306 and a second incision line 307 between the separating line 5 and the free edge 303 on a further plane parallel to a separating plane containing the separating line 5.

In order to make the first incision line 306 and the second incision line 307, the method comprises using cutting tools positioned transversally to the axis Z.

If, during production of the cap 1, the axis Z of the cap is positioned vertically, then advantageously the incision line 7 may be obtained with horizontal cutting tools, after the cap 1 has been made, that is to say, with horizontal blades.

Optionally, in order to give greater flexibility to the connecting portion 308 and to the region 309, the method comprises the step of making two break lines 6 parallel to the axis Z and parallel to each other, positioned at the inner ends of the first separating line 306 and the second separating line 307. For this purpose, cutting tools can be used which are positioned parallel to the axis Z.

If the axis Z is positioned vertically, then the break lines 6 can be obtained with vertical cutting tools and that is to say, vertical blades can be used after the cap 1 has been made.

The horizontal blades may be used in a first cutting station, not illustrated, and the vertical blades in a second cutting station, not illustrated, that is to say, to cut horizontally and vertically in succession the cap 1 grouping together the cutting tools transversal to the axis Z and the cutting tools parallel to the axis Z.

The cutting tools positioned transversally to the axis Z and/or the cutting tools positioned parallel to the axis Z may also be suitably arranged in such a way as to make angularly in succession the first incision line 306, a break line 6, the other break line 6, the second incision line 307.

It should be noted, therefore, that in order to make the cap 1 according to the invention, traditional moulds can be used since the first incision line 306, the second incision line 307 and the break lines 6 can be made as cut lines by means of a cutting operation in a simple and inexpensive manner.

The invention claimed is:

1. A closing cap for a container, comprising:

a lateral wall extending around an axis and a transversal wall positioned at one end of the lateral wall, a separating line positioned on the lateral wall to define:

a retaining ring, which is configured to remain anchored to a neck of the container and extends as far as a free edge;

a closing element removably engageable with the neck, so as to open or close the container;

wherein the separating line extends around the axis and is circumferentially interrupted to define in the lateral wall a joining zone, which extends for a first angle, in which the retaining ring and the closing element are joined;

wherein the retaining ring comprises:

an engagement element which projects inwards from the free edge and is configured to engage with a locking ring of the neck, the engagement element being in a bent configuration when the cap is in the closed condition;

a connecting portion, which is positioned at least in the joining zone and extends for a second angle;

a first incision line and a second incision line, which are transversal to the axis and are positioned circumferentially at the sides of the connecting portion;

the first incision line and the second incision line being configured to allow deformability at least of the connecting portion and of a region of the engagement element, which extends at least in the second angle, so that in a final step of a first opening of the closing element, the region goes beyond the locking ring and deforms, being positioned resting on the locking ring in an extended configuration.

2. The cap according to claim 1, wherein the first incision line and the second incision line are interposed between the separating line and the free edge and are parallel to each other.

3. The cap according to claim 1, wherein the first incision line and the second incision line lie in a same plane perpendicular to the axis and have a same length.

4. The cap according to claim 1, wherein the joining zone has a center line, a center line of the connecting portion coinciding with the center line of the joining zone, the first incision line and the second incision line being positioned symmetrically relative to a plane containing the axis and the center line of the joining zone.

5. The cap according to claim 1, and further comprising two break lines on the lateral wall, positioned parallel to the axis, the two break lines extending in the connecting portion and being configured to give further deformability to the connecting portion and to the region.

6. The cap according to claim 5, wherein the two break lines internally delimit respectively the first incision line and the second incision line or they are positioned inside the connecting portion.

7. The cap according to claim 1, wherein the second angle is less than the first angle.

8. The cap according to claim 1, wherein the second angle is between 5° and 90°.

9. The cap according to claim 1, wherein the first angle is between 20° and 90°.

10. The cap according to claim 1, wherein the first incision line and the second incision line extend respectively for a third angle and for a fourth angle, each of between 20° and 90°.

11. The cap according to claim 1, wherein the region is configured to emit an audible and/or tactile indication when the entire region goes beyond the locking ring and extends.

12. The cap according to claim 1, wherein, when the cap is in the open condition, the connecting portion is overturned and the free edge of the connecting portion is facing towards a supply opening of the neck.

13. The cap according to claim 1, wherein the first incision line and the second incision line are configured to give deformability to the connecting portion and to the region along an axis which is parallel to the axis of symmetry so that, during an initial step of the first opening, the region still in the bent configuration temporarily goes beyond the locking ring moving towards an end edge of the neck, to allow the closing element to completely disengage from the neck and subsequently again goes beyond the locking ring, moving in the opposite direction, when the closing element has completely disengaged.

14. The cap according to claim 1, wherein the region is configured to remain resting on the locking ring after the first opening and to bend when the closing element is again positioned to close the neck of the container.

15. The cap according to claim 8, wherein the second angle is between 10° and 60°.

16. The cap according to claim 8, wherein the second angle is equal to 20°.

17. The cap according to claim 9, wherein the first angle is between 40° and 60°.

18. The cap according to claim 10, wherein the first incision line and the second incision line extend respectively for a third angle and for a fourth angle, each of between 30° and 60°.

* * * * *